United States Patent [19]

Nishiguchi et al.

[11] 4,315,715

[45] Feb. 16, 1982

[54] DIFFUSER FOR FLUID IMPELLING DEVICE

[75] Inventors: Fumio Nishiguchi, Yokohama; Masataka Ueno; Masanobu Kimura, both of Yokosuka, all of Japan

[73] Assignee: Nissan Motor Company, Limited, Yokohama, Japan

[21] Appl. No.: 46,992

[22] Filed: Jun. 8, 1979

[30] Foreign Application Priority Data

Jul. 26, 1978 [JP] Japan ..... 53-101775[U]

[51] Int. Cl.[3] ..... F01D 9/00

[52] U.S. Cl. ..... 415/207; 415/177; 415/209; 415/DIG. 1; 138/37

[58] Field of Search ..... 138/37, 39, 40; 415/207, DIG. 1, 208, 209, 177; 60/751, 39.23

[56] References Cited

U.S. PATENT DOCUMENTS

| | | | |
|---|---|---|---|
| 2,702,986 | 3/1955 | Kadosch et al. | 239/265.19 |
| 2,735,612 | 2/1956 | Hausmann | 415/DIG. 1 |
| 3,552,877 | 1/1971 | Christ et al. | 415/209 |
| 4,083,180 | 4/1978 | Thompson et al. | 415/177 |

*Primary Examiner*—Leonard E. Smith

[57] ABSTRACT

A diffuser for a fluid impelling device such as a radial or axial turbine, comprising outer and inner casing members radially spaced apart from each other and thereby forming therebetween a diffuser chamber having annular cross-section which gradually increases in area toward the gas outlet end of the diffuser, wherein a flow throttling element is provided or the inner casing member is shaped to have a flow throttling portion so that the diffuser chamber is throttled at the gas outlet end for precluding separation of gas flow from an inner surface of the outer casing member.

6 Claims, 9 Drawing Figures

Fig. 7
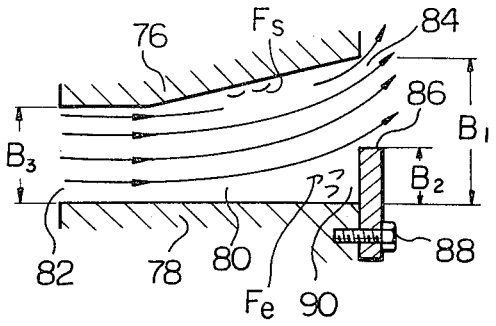
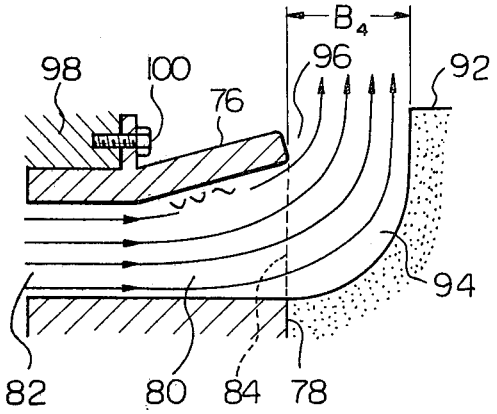
Fig. 8
Fig. 9
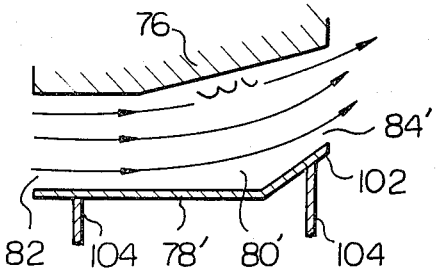

DIFFUSER FOR FLUID IMPELLING DEVICE

FIELD OF THE INVENTION

The present invention relates to a diffuser for use in a fluid impelling device. While a diffuser herein proposed may be advantageously used in any of such fluid impelling devices, the features of a diffuser according to the present invention will be best exploited in a gas turbine for use as a prime mover for a land transportation vehicle such as typically an automotive vehicle.

DESCRIPTION OF THE PRIOR ART

In a stationary, heavy-duty gas turbine used as, for example, as a power plant for industrial purposes, exacting design consideration need not be paid to the space requirement for the diffuser to be equipped in the power plant. The diffuser for use in such a power plant can therefore be designed and engineered to have a sufficient axial length for providing an adequately large ratio between the cross-sectional areas of the diffuser chamber at the gas inlet and outlet ends of the chamber. Since the diffuser is sufficiently elongated in axial direction, the cross-sectional area of the diffuser chamber increases at a limited rate from the gas inlet end to the gas outlet end of the diffuser chamber and, for this reason, the high-pressure gas to be discharged through the diffuser is enabled to flow in the diffuser chamber without causing separation of gas flow from an inner surface of the diffuser defining the diffuser chamber. Any desired pressure recovery factor can therefore be achieved in a diffuser of this nature. The pressure recovery factor herein referred to is defined as the ratio of the difference between the static pressures at the gas inlet and outlet ends of the diffuser chamber to the dynamic pressure at the gas inlet end of the diffuser chamber and is written as $$\frac{Po - Pi}{\frac{1}{2}\rho V^2}$$

where Po and Pi are the static pressures of gas at the gas outlet and inlet ends, respectively, of a diffuser chamber, $\rho$ is the mass density of the gas and V is the average velocity of the flow of the gas in the diffuser chamber.

In contrast to a stationary gas turbine for industrial use, a gas turbine for use in an automotive vehicle is required to reduce the space for the accommodation of the diffuser therein and, for this reason, the diffuser cannot be designed to have a sufficient axial length. If, therefore, it is desired to have a diffuser designed to provide an adequate ratio between the cross-sectional areas of the diffuser chamber at the gas inlet and outlet ends of the chamber for the purpose of achieving a desired pressure recovery factor, the cross-sectional area of the diffuser chamber must be increased steeply toward the gas outlet end of the diffuser chamber and promotes the tendency of gas flow to be separated from the inner surface diffuser. The separation of the gas flow from the inner surface of a diffuser results in reduction of the effective ratio between the cross-sectional areas of the diffuser chamber at the gas inlet and outlet ends of the chamber and critically impairs the pressure recovery factor of the diffuser. The present invention contemplates elimination of these drawbacks in prior-art diffusers for fluid impelling devices, particularly land transportation vehicles such as automotive vehicles.

SUMMARY OF THE INVENTION

In accordance with the present invention, there is provided a diffuser for a fluid impelling device, comprising outer and inner casing members radially spaced apart from each other and forming therebetween a diffuser chamber having gas inlet and outlet ends and annular cross-section increasing in area toward the gas outlet end of the diffuser chamber, and flow throttling means radially outwardly projecting from the inner casing member and throttling the diffuser chamber at the gas outlet end of the chamber. The diffuser thus provided with the flow throttling means may be of the type having an axially flaring or bell-mouthed diffuser chamber or of the type having an axially frusto-conical diffuser chamber. If desired, the features of the diffuser proposed by the present invention may also be incorporated into a diffuser of the type having a generally cylindrical diffuser chamber.

BRIEF DESCRIPTION OF THE DRAWINGS

The drawbacks inherent in prior-art diffusers and the features and advantages of a diffuser according to the present invention will be more clearly understood from the following description taken in conjunction with the accompanying drawings in which:

FIG. 7 is a longitudinal sectional view showing part of another preferred embodiment of a diffuser according to the present invention and the flows of gas in the diffuser;

FIG. 8 is a longitudinal sectional view showing part of a modification of the embodiment illustrated in FIG. 7 and the flows of gas in the modified embodiment; and FIG. 9 is a longitudinal sectional view showing part of another modification of the embodiment illustrated in FIG. 7 and the flows of gas in the modified embodiment.

DETAILED DESCRIPTION OF THE PRIOR-ART

Figure 1:
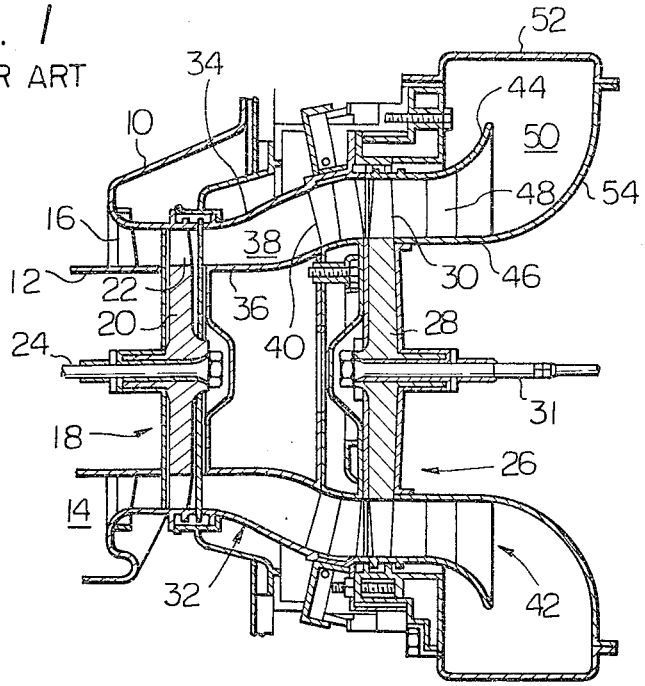
Fig. 1 PRIOR ART
FIG. 1 is a longitudinal sectional view showing a representative example of a prior-art gas turbine used as a prime mover for an automotive vehicle.

Before entering into detailed description of the various embodiments of the present invention, description will be further made regarding the drawbacks which have been encountered in prior-art diffusers for fluid impelling devices.

While the features of a diffuser according to the present inventions may be applied to diffusers for various types of fluid impellent devices such as centrifugal fans, pumps and compressors, description will be made pro tempore regarding a diffuser incorporated in a gas turbine for use in an automotive vehicle.

As is well known in the art, a gas turbine for use as a power plant for an automotive vehicle is usually designed as a single-stage separate-turbine type comprising two sections which are arranged in series. The two sections consist of a gasifier and impeller section and a power section. The gasifier and impeller section comprises an air compressor having a compressor rotor carrying a series of blades around the outer peripheral edge of the rotor. When the compressor rotor is driven to rotate about the axis of rotation thereof, air sucked into the compressor through the air intake of the turbine engine is carried around the rotor and is blown under compression into a combustion chamber formed around the compressor rotor and defined between radially spaced apart outer and inner casing shells which form part of the stationary casing structure of the gas turbine. The outer and inner casing shells thus defining the combustion chamber therebetween are indicated in part at 10 and 12, respectively, in FIG. 1 which shows part of a known gas turbine engine for automotive use. Into the compressed air injected into the combustion chamber (which is indicated in part by reference numeral 14 in FIG. 1) is sprayed fuel ejected from the fuel nozzle (not shown) projecting into the combustion chamber 14. The high-pressure, high-temperature gas thus produced in the combustion chamber 14 by the combustion of the fuel with the agency of the compressed air is directed against a series of stationary guide blades which are arranged in annular configuration immediately upstream of the discharge end of the gasifier and impeller section and which are secured to the above-mentioned outer and inner casing shells 10 and 12 as indicated at 16 in FIG. 1. At the discharge end of the gasifier and impeller section of the turbine engine is positioned a compressor turbine 18 which is composed of a disc-type rotor 20 carrying a series of curved blades 22 along the outer peripheral edge of the rotor 20. The compressor turbine rotor 20 is positioned axially in alignment with the rotor of the air compressor and is rotatable on a compressor drive shaft 24 which is secured at one end thereof to the compressor turbine rotor 20 and at the other end thereof to the rotor of the air compressor through not shown in the drawings. The high-pressure, high-temperature gas passed to the stationary guide blades 16 on the outer and inner casing shells 10 and 12 as above described is further directed by the blades 16 onto the curved vanes 22 on the compressor turbine rotor 20 and causes the turbine rotor 20 to spin about the axis of rotation thereof. The rotation of the turbine rotor 20 is carried through the compressor drive shaft 24 to the rotor of the air compressor and drives the compressor rotor for rotation with the turbine rotor 20 and the shaft 24, thereby enabling the air compressor to continuously supply compressed air into the combustion chamber 14. The gasifier and impeller section of the gas turbine engine further comprises an igniter projecting into the combustion chamber 14 though not shown in the drawings but, once the mixture of the fuel and compressed air initially introduced into the combustion chamber 14 is fired by the igniter, the combustion flame produced in the chamber 14 continues as long as fuel is thereafter supplied into the combustion chamber 14.

The power section of the gas turbine engine is positioned downstream of and axially in alignment with the gasifier and impeller section thus constructed and arranged and comprised a power turbine 26 which is composed of a disc-type rotor 28 carrying a series of curved blades 30 around the outer peripheral edge of the rotor 28 and which is larger in size than the compressor turbine 18 as will be seen from FIG. 1. The power turbine rotor 28 is rotatable with a turbine output shaft 31 which is axially aligned with the compressor drive shaft 24 and which is secured at one thereof to the power turbine rotor 28 and at the other end thereof to a gear forming part of a power transmission gear assembly (not shown).

The transfer of the combustion gas from the gasifier and impeller section to the power section is conducted through a primary or intermediate diffuser 32 constituted by outer and inner casing members or shrouds 34 and 36 which are securely connected to the casing structure of the gas turbine and which intervene between the respective blade areas of the compressor and power turbines 18 and 26. The outer and inner shrouds 34 and 36 are radially spaced apart from each other and thus form therebetween a diffuser chamber 38 having a gas inlet end located immediately downstream of the curved blades 22 of the compressor turbine 18 and a gas outlet end located immediately upstream of the curved blades 30 of the power turbine 26. The diffuser chamber 38 has annular cross-section which gradually increases in area and inside and outside diameters from the inlet end toward the outlet end of the chamber 38 as shown. The intermediate diffuser 32 has built therein a series of stationary, variable-angle, curved blades 40 which are positioned in a downstream end portion of the diffuser chamber 38, viz., immediately upstream of the blades 30 on the rotor 28 of the power turbine 26. Thus, the high-pressure, high-temperature gas which leaves the blades 22 on the rotor 20 of the compressor turbine 18 and enters the power turbine 26 strikes these blades 40 and is thereby directed against the curved blades 30 of the power turbine 26. The resulting high pressure of the gas impinging upon the blades 30 of the power turbine 26 causes the power turbine rotor 28 to spin about the axis of rotation thereof at high speed. The rotation of the power turbine rotor 30 is transmitted through the turbine output shaft 32 to the power transmission gear assembly and is further transmitted, upon reduction of the speed in the transmission gear assembly, to the driving road wheels of the vehicle through, for example, a final drive gear unit (not shown) of the vehicle.

To permit a circumferential discharge of the combustion gas from the power section, the gas turbine further comprises a secondary or terminal diffuser 42 constituted by outer and inner casing members or shrouds 44 and 46 which are securely connected to the casing structure of the gas turbine. The outer and inner shrouds 44 and 46 are radially spaced apart from each other and thus form therebetween a diffuser chamber 48 having a gas inlet end located immediately downstream of the curved blades 30 of the power turbine 26. The diffuser chamber 48 extends axially downstream of the blade area of the power turbine 26 and has annular cross-section which gradually increases in area and inside and outside diameters from the gas inlet end of the diffuser 42 toward a gas outlet end which is open in an annular exhaust chamber defined between an outer casing member 50 constructed separately of the outer shroud 44 of the terminal diffuser 42 and an inner casing member 52 which is integral with the inner shroud 46 of the diffuser 42.

Figure 2:
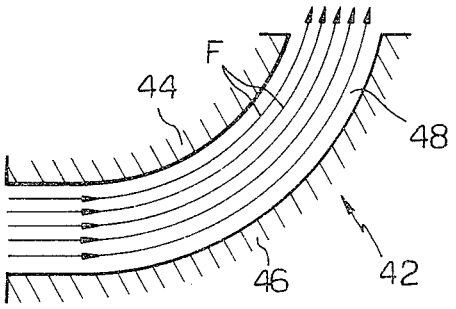
Fig. 2 PRIOR ART
FIG. 2 is a longitudinal sectional view showing an ideal flow of gas in a diffuser incorporated in the gas turbine illustrated in FIG. 1.
Figure 3:
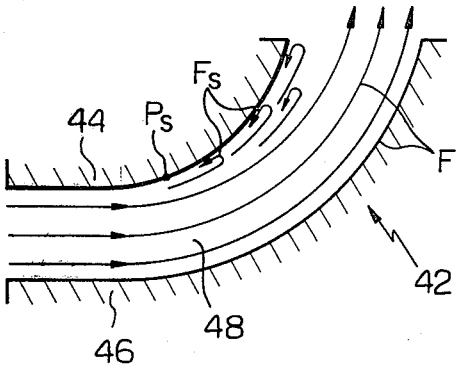
Fig. 3 PRIOR ART
FIG. 3 is a longitudinal sectional view showing an actual flow of gas in the diffuser provided in the gas turbine of FIG. 1.

Each of the primary and secondary or intermediate and terminal diffusers 32 and 42 thus constructed and arranged has a generally flaring configuration in its entirety and the outer shroud 44 of the terminal diffuser 42 in particular has a bell-mouthed downstream end portion 44*a* as shown so that the gas to be discharged through the diffuser 42 is to form a laminar flow throughout the extent of the diffuser chamber 48 as indicated by F in FIG. 2. Actually, however, the flow of the high-pressure gas in the diffuser chamber 48 tends to separate from the inner surface of the bell-mouthed end portion 44*a* of the outer shroud 44 as indicated at Fs in FIG. 3. As a consequence, the effective cross-sectional area through which the high-pressure gas flows in the downstream end portion of the diffuser chamber 48 decreases by a value corresponding to the cross-sectional area of the boundary layer of the gas flow separated from the inner surface of the end portion 44*a* of the outer shroud 44. The effective sectional area at the gas outlet end of the diffuser 42 being thus reduced, the diffuser 26 cannot be constructed to provide an adequate pressure recovery factor because of the limited axial length of the diffuser 42. Indicated by Ps in FIG. 3 is a separation point at which the separation of the gas flow from the inner surface of the outer shroud 44 of the diffuser 26 initially takes place.

Figure 4:
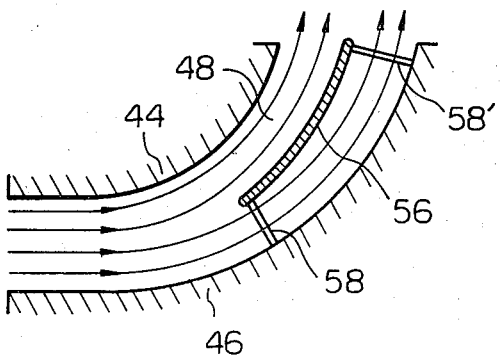
Fig. 4 PRIOR ART
FIG. 4 is a longitudinal sectional view showing part of a prior-art diffuser and the flow of gas therein.

To provide a solution to this problem, it has been proposed and out into practice to have a guide vane positioned in the neighborhood of the separation point Ps of the diffuser chamber 48 as indicated at 56 in FIG. 4. The guide vane 56 is mounted on the inner shroud 46 of the diffuser 42 by means of suitable brackets 58 and 58' and is longitudinally elongated along the streamlines in the diffuser chamber 48 so that the flow of the high-pressure gas in the diffuser chamber 48 is in part forcibly guided to flow on the inner surface of the downstream end portion 44*a* of the outer shroud 44. Provision of the guide vane 56 thus arranged to prevent the separation of gas flow from the inner surface of the outer shroud 44 arouses another problem in that, since the guide vane 56 is positioned within the diffuser chamber 48 and as a consequence the brackets 58 and 58' supporting the guide vane 56 are mounted on an internal wall portion of the inner shroud 46 or any other structural element of the diffuser 42, cracks tend to be produced in such a wall portion by the attack of heat from the high-temperature gas in the diffuser chamber 48. This will critically impair the durability of the diffuser 42 as a whole.

DETAILED DESCRIPTION OF THE INVENTION

The present invention aims at resolution of these problems in prior-art diffusers for fluid impelling devices by provision of a flow throttling means at the gas outlet end of the diffuser chamber so that the ratio of the cross-sectional area at the gas inlet end of the diffuser chamber to the effective cross-sectional area at the gas outlet end of the diffuser chamber is significantly augmented to add to the effective pressure recovery factor of the diffuser. The flow throttling means being thus provided at the gas outlet end of the diffuser chamber, the gas flow once separated from the outer shroud downstream of the separation point of the diffuser chamber is at least in part forced to re-attach to the inner surface of the outer shroud as the gas flow approaches the throttled gas outlet end of the diffuser chamber. Provision of a flow throttling means at the gas outlet end of the diffuser chamber is, thus, also useful for the lessening of the gas flow separated from the outer shroud of a diffuser, as will be understood more clearly as the description proceeds.

FIGS. 5 to 9 of the drawings show embodiments of a diffuser thus provided with a flow throttling means in accordance with the present invention. Each of the diffusers herein shown may be used as part of a gas turbine power plant for use in, for example, an automotive vehicle as is the case with the prior-art diffuser incorporated in the gas turbine engine illustrated in FIG. 1 but is applicable not only to a gas turbine but to any other fluid impelling device such as a centrifugal pump, fan or compressor.

Figure 5:
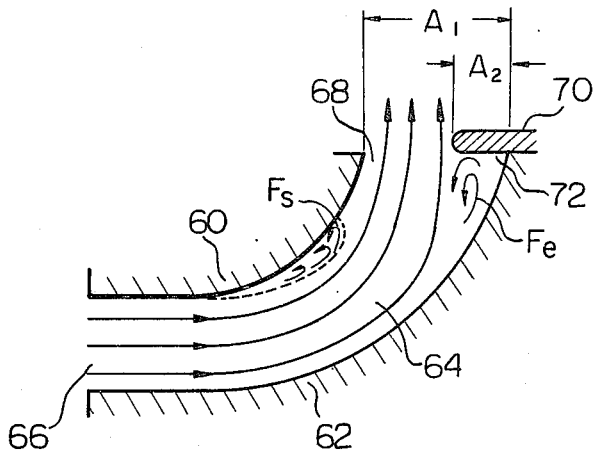
FIG. 5 is a longitudinal view showing part of a preferred embodiment of a diffuser according to the present invention and the flows of gas in the diffuser.

Referring to FIG. 5, a diffuser embodying the present invention is schematically shown comprising outer and inner casing members 60 and 62 which are radially spaced apart from each other to have formed therebetween a diffuser chamber 64 having an axially open gas inlet end 66 and a circumferentially open gas outlet end 68. The outer and inner casing members 60 and 62 are shaped in such a manner that the diffuser chamber 64 defined therebetween has cross-section which graually increases in area and inside and outside diameters toward the gas outlet end 68 of the diffuser chamber 64. Thus, the diffuser chamber 64 has a generally flaring or bell-mouthed configuration which gradually enlarges with curvature from the gas inlet end 66 toward the gas outlet end 68 of the chamber 64. The flow throttling means provided in the diffuser thus constructed is constituted by a ring-shaped baffle element 70 which is securely attached to the entire circumferential edge of the inner casing member 62 at the gas outlet end of the diffuser chamber 64. The baffle element 70 axially projects a suitable length from the circumferential edge of the inner casing member 62 toward the circumferential edge of the outer casing member 60 along the gas outlet end 68 of the diffuser chamber 64 and, thus, forms a circumferential corner zone between the inner peripheral surface of the baffle element 70 and the inner surface of a downstream end portion of the inner casing member 62 as indicated in part by numeral 72 in FIG. 5. The diffuser chamber 64 is thus throttled at the gas outlet end 68 thereof along the circumferential edge of the inner casing member 62. The baffle element 70 is secured to the inner casing member 62 of the diffuser by welding or by suitable fastening means (not shown).

The baffle element 70 being thus provided at the gas outlet end of the diffuser chamber 64, the flow of a high-pressure gas separated from the inner surface of the outer casing member 60 downstream of the separation point Ps as indicated by Fs in FIG. 5 is urged to flow on the inner surface of the outer casing member 60 as the separated gas flow approaches the gas outlet end 68 of the diffuser chamber 64. The gas flow once separated from the inner surface of the outer casing member 60 is in this fashion at least in part forced to re-attach to the inner surface of the outer casing member 60 in the vicinity of the gas outlet end of the diffuser chamber 64. Thus, the throttled cross-sectional area of the diffuser chamber 64 at the gas outlet end 68 of the chamber, viz., the difference between the original cross-sectional area $A_1$ and the baffled cross-sectional area $A_2$ of the diffuser chamber 64 at the gas outlet end 68 of the chamber can be utilized substantially as the effective cross-sectional area through which the gas flow in the diffuser chamber 64 is to be discharged therefrom. If, in this instance, the baffle element 70 is sized and/or arranged so that the difference ($A_1$-$A_2$) between the cross-sectional areas $A_1$ and $A_2$ is smaller than the cross-sectional area $A_3$ of the diffuser chamber 64 at the gas inlet end 66 of the chamber 64, the resultant construction could not function as a diffuser since the function of diffusers in general is to convert part of kinetic energy of fluid into pressure energy by a gradual increase in the cross-sectional area of the fluid flow. For this reason, the geometry of the baffle element 70 provided in the embodiment illustrated in FIG. 5 should be selected in such a manner that the throttled cross-sectional area of the diffuser chamber 64 at the gas outlet end of the chamber or, more exactly the difference between the original cross-sectional area $A_1$ and the baffled cross-sectional area $A_2$ of the diffuser chamber 64 at the gas outlet end of the chamber be larger than the cross-sectional area $A_3$ of the diffuser chamber 64 at the axially open gas inlet end 66 of the chamber. In a diffuser of the type having an axially flaring or bell-mouthed configuration as in the embodiment shown in FIG. 5, it is preferable that the throttled cross-sectional area ($A_1$-$A_2$) of the diffuser chamber at the gas outlet end of the chamber be approximately two to three times larger than the cross-sectional area ($A_3$) of the diffuser chamber at the gas inlet end of the chamber.

In the arrangement illustrated in FIG. 5, the circumferential corner zone 72 formed between the inner peripheral surface of the ring-shaped baffle element 70 and the inner surface of the downstream end portion of the inner casing member 62 constitutes a dead pocket along the inner peripheral surface of the baffle element 70 and is causative of production of eddy currents of gas in the dead pocket as indicated by Fe in FIG. 5.

Figure 6:
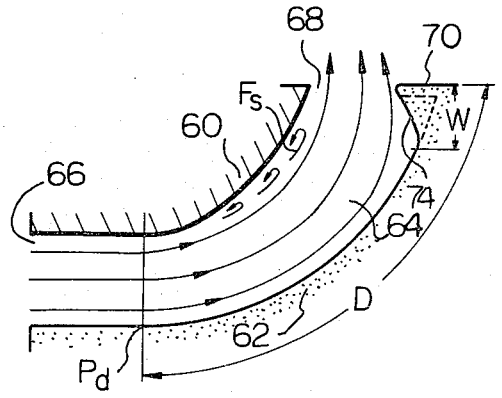
FIG. 6 is a view similar to FIG. 5 but shows a modification of the diffuser illustrated in FIG. 5.

FIG. 6 shows an embodiment which is largely similar to the embodiment of FIG. 5 but which is adapted to prevent production of such eddy currents along the inner peripheral surface of the baffle element 70. In the embodiment illustrated in FIG. 6, an annular strip 74 of heat insulator is closely attached to the inner peripheral surface of the baffle element 70 and the inner surface of a downstream end portion of the inner casing member 62 of the diffuser. The annular strip 74 has an inner circumferential surface exposed to the diffuser chamber 64 and having a cross-section which is substantially streamlined toward the gas outlet end 68 of the diffuser chamber 64 as shown. The annular strip 74 is preferably so sized and/or shaped in cross-section that the width W of its surface attached to the inner surface of the downstream end portion of the outer casing member 62 is approximately equal to 25 percent of the distance D between the gas outlet end 68 of the diffuser chamber 64 and a point Pd at which the inner surface on the inner casing member 62 starts to be spaced wider apart from the inner surface of the outer casing member 60 as will be seen from FIG. 6. The distance D above defined is herein referred to simply as effective diffusion distance.

While each of the embodiments hereinbefore described with reference to FIGS. 5 and 6 has an axially flaring or bell-mouthed configuration gradually enlarging is not only cross-sectional area but also in both inside and outside diameters from the gas inlet end toward the gas outlet end of the diffuser chamber, the flow throttling means proposed by the present invention may be provided in a diffuser having a diffuser chamber defined by a frusto-conical outer surface and a cylindrical inner surface. FIG. 7 shows an embodiment of the present invention applied to a diffuser of such a nature.

Referring to FIG. 7, the diffuser comprises outer and inner casing members 76 and 78 which are radially spaced apart from each other and which have thus formed therebetween a diffuser chamber 80 having annular cross-section and axially open gas inlet and outlet ends 82 and 84. The outer casing member 76 has a frusto-conical inner peripheral surface which is enlarged without curvature toward the gas outlet end 84 while the inner casing member 78 has a cylindrical inner surface having a constant diameter throughout the axial length of the casing member 78. An annular baffle element 86 is securely attached to the inner casing member 78 adjacent the gas outlet end 84 of the diffuser chamber 80 by suitable fastening means such as a bolt 88 secured to an end wall portion of the casing member 78 as shown. The baffle element 86 radially outwardly projects a suitable length from the circumferential edge of the inner casing member 78 toward the circumferential edge of the outer casing member 76 along the gas outlet end 84 of the diffuser chamber 80 and, thus, forms a circumferential corner zone 90 between the inner end face of the baffle element 86 and the inner surface of a downstream end portion of the inner casing member 78 while throttling the diffuser chamber 80 at the gas outlet end 84 of the chamber along the circumferential edge of the inner casing member 78. The baffle element 86 provided in the diffuser thus constructed and arranged is preferably sized and/or arranged in such a manner that the throttled cross-sectional area of the diffuser chamber 80 at the gas outlet end 84 of the chamber, viz., the difference between the original cross-sectional area $B_1$ and the baffled cross-sectional area $B_2$ of the diffuser chamber 80 at the gas outlet end 84 of the chamber is larger by about 1.5 to about 2.5 times the cross-sectional area $B_3$ of the diffuser chamber 80 at the gas inlet end 82 of the chamber.

In order to preclude production of eddy currents Fs in the dead pocket formed by the corner zone 90 inside the baffle element 86, the baffle element 86 in the embodiment of FIG. 7 may be replaced with a guide member 92 as in the embodiment of the present invention illustrated in FIG. 8. In the embodiment of FIG. 8, the outer and inner casing members 76 and 78 per se are arranged substantially similarly to those of the embodiment shown in FIG. 7 and the guide member 92 has an inner surface which forms, in addition to the diffuser chamber 80 formed between the outer and inner casing members 76 and 78, a flow guide chamber 94 between the outer casing member 76 and the inner surface of the guide member 92. The inner surface of the guide member 92 continuously extends from the inner surface of the inner casing member 78 and forms a circumferentially open gas outlet end 96 between the circumferential edge of the guide member 92 and the corresponding circumferential edge of the outer casing member 76. The cross-sectional area $B_4$ of the flow guide chamber 94 at the gas outlet end 96 of the chamber 94 is smaller than the cross-sectional area $B_1$ (FIG. 7) of the diffuser chamber 80 at the gas outlet end 84 (indicated by a broken line) of the chamber 80. Preferably, furthermore, the inner surface of the guide member 92 is streamlined from the gas outlet end 84 of the diffuser chamber 80 to the gas outlet end 84' of the flow guide chamber 94 and the guide member 92 is constructed of a heat insulator. In FIG. 8, the outer casing member 76 of the diffuser is shown to be secured to a support structure 98 by means of a bolt 100.

FIG. 9 shows another modification of the diffuser illustrated in FIG. 7. The diffuser shown in FIG. 9 comprises an outer casing member 76 shaped similarly to its counterpart in the diffuser of FIG. 7 and an inner casing member 78' having a downstream end wall portion 102 shaped to have an axially frusto-conical inner surface which downstream merges out of the cylindrical inner surface of the remaining, viz., upstream wall portion of the casing member 78' and which forms a throttled gas outlet end 84' between the enlarged edge of the inner casing member 102 and the corresponding edge of the outer casing member 76. The inner casing member 78' is shown to be reinforced by rigid reinforcing members 104.

What is claimed is:

1. A diffuser for a fluid impelling device, comprising: outer and inner casing members radially spaced apart from each other and forming therebetween a diffuser chamber having a gas inlet end open axially and a gas outlet end open circumferentially, said diffuser chamber being of annular cross-section increasing toward said gas outlet end and gradually enlarging with curvature toward said gas outlet end; and flow throttling means for throttling said diffuser chamber at said gas outlet end, said flow throttling means including a ring-shaped baffle element secured to said inner casing member and circumferentially extending along said gas outlet end;

in which the cross-sectional area of said diffuser chamber at the throttled gas outlet end of the diffuser chamber is about two to three times larger than the cross-sectional area of the diffuser chamber at said gas inlet end.

2. A diffuser for a fluid impelling device, comprising: outer and inner casing members radially spaced apart from each other and forming therebetween a diffuser chamber having gas inlet and outlet ends open axially and annular cross-section increasing toward said gas outlet end, said outer casing member having a frusto-conical inner surface enlarging in cross-section toward said gas outlet end; and flow throttling means for throttling said diffuser chamber at said gas outlet end, said flow throttling means including an annular baffle element secured to said inner casing member and circumferentially extending along said gas outlet end;

in which the cross-sectional area of said diffuser chamber at the throttled gas outlet end of the diffuser chamber is about 1.5 to 2.5 times larger than the cross-sectional area of the diffuser chamber at said gas inlet end.

3. A diffuser for a fluid impelling device, comprising outer and inner casing members radially spaced apart from each other and forming therebetween a diffuser chamber having gas inlet and outlet ends and an annular cross-section increasing toward the gas outlet end of the diffuser chamber, and baffle type flow throttling means disposed at the gas outlet end of said diffuser chamber and radially outwardly projecting from the inner casing member to throttle the diffuser chamber at the gas outlet end of the chamber, said outer casing member having a frusto-conical inner surface enlarging in cross-section toward the gas outlet end of the diffuser chamber and in which the gas inlet and outlet ends of said diffuser chamber are open axially, said flow throttling means comprising an annular baffle element secured to said inner casing member and circumferentially extending along the gas outlet end of the diffuser chamber, the cross-sectional area of said diffuser chamber at the throttled gas outlet end of the diffuser chamber being about 1.5 to 2.5 times larger than the cross-sectional area of the diffuser chamber at said gas inlet end.

4. A diffuser for a fluid impelling device, comprising: outer and inner casing members radially spaced apart from each other and forming therebetween a diffuser chamber having a gas inlet end open axially and a gas outlet end open circumferentially, said diffuser chamber being of annular cross-section increasing toward said gas outlet end and gradually enlarging with curvature toward said gas outlet end;

flow throttling means for throttling said diffuser chamber at said gas outlet end, said flow throttling means including a ring-shaped baffle element secured to said inner casing member and circumferentially extending along said gas outlet end; and an annular strip secured to said baffle element and filling a circumferential corner zone formed between the inner peripheral surface of said baffle element and the inner surface of a downstream end portion of said inner casing member, said annular strip having a circumferential surface attached to said inner surface of said inner casing member;

in which the width of said circumferential surface of said annular strip is approximately equal to 25 percent of the effective diffusion distance of said diffuser chamber.

5. A diffuser for a fluid impelling device, comprising outer and inner casing members radially spaced apart from each other and forming therebetween a diffuser chamber having gas inlet and outlet ends and an annular cross-section increasing toward the gas outlet end of the diffuser chamber, baffle-type flow throttling means disposed at the gas outlet end of said diffuser chamber and radially outwardly projecting from the inner casing member to throttle the diffuser chamber at the gas outlet end of the chamber, said diffuser chamber gradually enlarging with curvature toward the gas outlet end thereof and having the gas inlet end open axially and the gas outlet end open circumferentially, said flow throttling means comprising a ring-shaped baffle element secured to said inner casing member and circumferentially extending along the gas outlet end of the diffuser chamber, and an annular strip secured to said baffle element and filling a circumferential corner zone formed between the inner peripheral surface of the baffle element and the inner surface of a downstream end portion of said inner casing member, said annular strip having a circumferential surface attached to the inner surface of the downstream end portion of the inner casing member, the width of said circumferential surface of the annular strip being approximately equal to 25 percent of the effective diffusion distance of the diffuser chamber.

6. A diffuser as set forth in claim 5, in which the cross-sectional area of said diffuser chamber at the throttled gas outlet end of the diffuser chamber is about two to three times larger than the cross-sectional area of the diffuser chamber at said gas inlet end.

* * * * *